United States Patent [19]

Kars et al.

[11] Patent Number: 4,757,594

[45] Date of Patent: Jul. 19, 1988

[54] METHOD OF PROVIDING THE INNER SIDE OF A NECK OPENING OF A VESSEL WITH A SYNTHETIC SLEEVE

[75] Inventors: Herman P. Kars, Uithoorn; Willem F. Kors, Woubrugge, both of Netherlands

[73] Assignee: Koninklijke Emballage Industrie van Leer B.V., Amstelveen, Netherlands

[21] Appl. No.: 884,972

[22] Filed: Jul. 14, 1986

[30] Foreign Application Priority Data

Jul. 18, 1985 [NL] Netherlands ..... 8502073

[51] Int. Cl.[4] ..... B23P 11/02

[52] U.S. Cl. ..... 29/447; 29/453; 29/525

[58] Field of Search ..... 29/447, 525, 453

[56] References Cited

FOREIGN PATENT DOCUMENTS

| | | |
|---|---|---|
| 291791 | 12/1965 | Netherlands . |
| 721061 | 12/1953 | United Kingdom . |
| 1032701 | 11/1963 | United Kingdom . |
| 1392603 | 8/1971 | United Kingdom . |

*Primary Examiner*—Timothy V. Eley

*Attorney, Agent, or Firm*—Brumbaugh, Graves, Donohue & Raymond

[57] ABSTRACT

Method of providing the inner side of a neck of a vessel with a synthetic sleeve provided with inner screw thread for a closure stop (15) said sleeve being provided with an outer collar (8) with the shape of a truncated cone having its smallest diameter at the outer end and smaller than the inner diameter of the neck (3) and its largest diameter larger than the inner diameter of the neck, which sleeve in heated condition is pressed into and through the neck until the collar snaps outwardly over the edge of the neck.

8 Claims, 1 Drawing Sheet

METHOD OF PROVIDING THE INNER SIDE OF A NECK OPENING OF A VESSEL WITH A SYNTHETIC SLEEVE

BACKGROUND OF THE INVENTION

This invention relates to a method of providing the innerside of a neck with a synthetic sleeve, which neck has been formed by the outwardly bent edge of an opening in the wall of a vessel, said sleeve being provided with an internal screw thread for a closure stop.

It is known in such a method to place the synthetic sleeve in a neck and subsequently to shrink the neck radially around the sleeve.

Said known method has several disadvantages. First, due to the shrinkage of the neck the sleeve may obtain an unround shape thereby preventing the closure stop screwed into it from closely engaging the above. Moreover, by deformation of the sleeve internal tensions may occur in the synthetic material which can promote the formation of tensional tears or may lead to shrinkage. Also, the resistance of the the sleeve against rotation inside the neck leaves much to be desired. Finally, it is difficult to seal the sleeve both at the inner side as well as at the outerside of the vessel wtih respect to the neck.

Accordingly, the purpose of the invention is to provide a vessel closure which avoids said disadvantages. (According to the invention this purpose is achieved by use of a sleeve having at one end an outer collar the outer surface of which has the shape of a truncated cone the smallest diameter thereof being disposed at the outer end of the sleeve,) which diameter is smaller than the inner diameter of the neck and of which the largest diameter is larger than the inner diameter of the neck and which at the end turned away from the collar has an outwardly turned flange the distance of which towards the collar is equal to or somewhat smaller than the length of the neck, which sleeve in heated condition is pressed into and through the neck until the collar snaps outwardly over the outer end of the neck.

By mounting the sleeve in heated condition inside the neck permanent deformations and inner tensions do not occur in the synthetic material. This leads to a pure round sleeve and accordingly to a very good sealing of the closure stop. Moreover, due to the absence of internal tensions the sleeve is not susceptible to the occurance of tensional tears or shrinkage.

SUMMARY OF THE INVENTION

According to a preferred embodiment the method takes place such that the neck is provided with inwardly directed impressions and the sleeve of ribs fitting into them. Due to this, rotation of the tension free mounted sleeve is avoided because it is almost tension free inside the neck. Due to said construction a large number of differing non-reinforced synthetic materials can be taken into account for the sleeve such as polyethylene, polypropylene, polyvinylchloride, ABS and the like.

According to another embodiment the method has the feature that the flange is welded upon unprepared clean steel. Due to this a good seal is obtained between the synthetic sleeve and the vessel wall. This way of sealing has the advantage with respect to the use of a sealing ring that no compression of sealing material takes place which also might lead to the occurance of tension tears or shrinkage. Moreover, the chemical resistance of the sealing materials used until now no longer plays a role.

In case the vessel wall is deformed, e.g. in that the vessel drops, the flange does follow said deformation due to which the sealing is maintained. Moreover, said connection is vacuum tight due to which no moisture can be sucked in from the outerside between the synthetic material and metal. Furthermore, the quality of the sealing is maintained under possible changes of temperature.

Moreover, the sleeve can be mounted upon vessels of different innersurface. To this end the method can be performed such that the welding takes place on unprepared clean steel.

The method can also be performed such that the welding takes place on prepared steel.

Moreover, the method can be performed such that the flange is welded upon a synthetic foil which itself has been adhered to the steel.

According to another embodiment the method can be performed such that the steel can be coated with a powder of thermoplastic synthetic resin prior to the welding of the flange upon the steel.

Finally the method can be performed such that the flange is welded upon a synthetic layer forming part of a loose liner of the vessel.

The invention will be further discussed with reference to the following drawings.

DETAILED DESCRIPTION OF THE DRAWINGS

Figure 1:
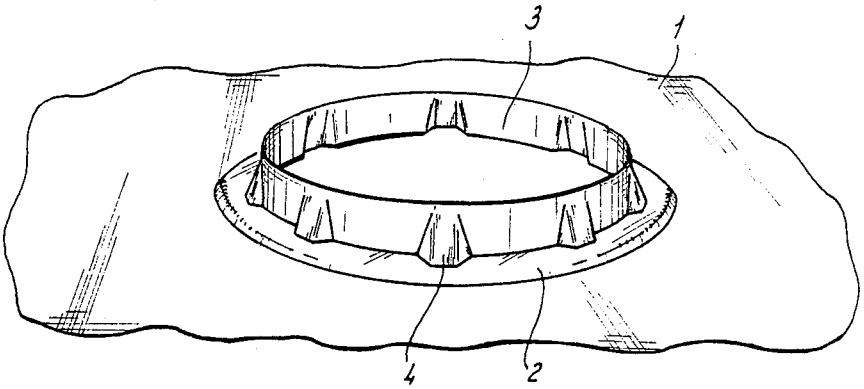
FIG. 1 shows a vessel wall with a neck formed by the outwardly bent edge of an opening in the wall of the vessel.

In FIG. 1 a vessel wall 1 has been shown into which a bent ring 2 has been provided joined by outwardly bent edge forming the neck 3. The neck 3 has been provided with a number of recesses 4.

Figure 2:
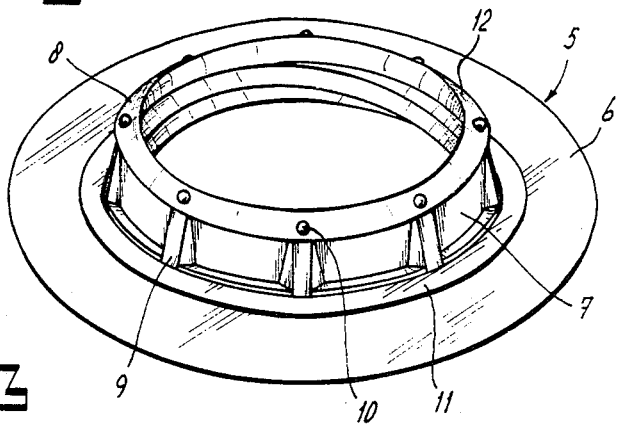
FIG. 2 shows a synthetic sleeve according to the invention.

The synthetic closure ring 5 shown in FIG. 2 comprises a flange 6, a sleeve 7 and a collar 8. The collar 8 has an outer surface in the shape of a truncated cone. Furthermore upon the outerside of the sleeve ribs 9 are provided and upon the outer surface of the collar guiding burls 10. At the location of the connection of the flange 6 to the sleeve 7 a ring 11 of increased thickness has been provided. In the interior of the sleeve screw thread 12 has been provided.

Figure 3:
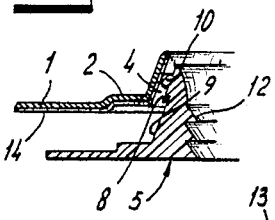
FIG. 3 shows a cross section through sleeve and neck at the location of a cam and recess respectively prior to pressing the sleeve into the neck.

(In FIG. 3, it is shown how the heated closure 5 is placed in the right position with respect to the neck 3.) The guiding burls 10 therewith are present in the recesses 4 which is possible without compressing the sleeve because the smallest diameter of the edge 12 of the truncated surface 8 is smaller than the inner diameter of the neck 3.

Figure 4:
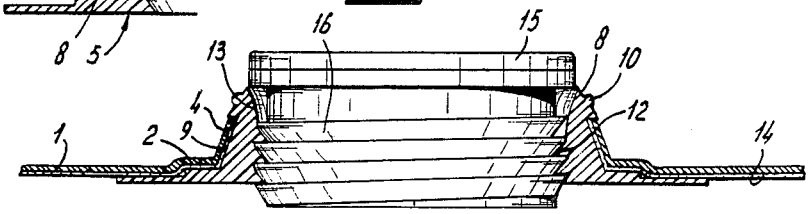
FIG. 4 shows a sleeve mounted inside a neck, both in cross section and with a closure stop.

In FIG. 4 the sleeve 7 is completely pressed into the neck 3, the edge 13 of the truncated surface 8, having a diameter which is larger than the inner diameter of the neck 3, being snapped outwardly over the neck 3. The ribs 9 are present in the recesses 4 of the neck 3 and the thick ring 11 is present in the bent ring 2. The flange 6 is pressed upon the inner side of the vessel wall 1 and welded to it. Said inner side can be provided with a coating 14, e.g. foil, loose liner and the like, to which the flange is adhered. In the sleeve 7 a closure stop 15 is screwed having corresponding outer screw thread 16.

What is claimed is:

1. A method of providing the inner side of a neck with a synthetic sleeve comprising:

forming a neck (3) with a desired inner diameter and length from an outwardly bent edge of an opening in a wall of a vessel, forming a sleeve (7) with an outer collar (8) at one end thereof, said outer collar (8) having an outer surface which is in the shape of a truncated cone, a smallest diameter of which is disposed at an outer end of said sleeve (7) and is smaller than said inner diameter of said neck (3), a largest diameter of which is turned away from the collar (8) and is formed so as to have an outwardly turned flange (6) which is displaced from the collar (8) a distance equal to or smaller than the length of the neck (3), said largest diameter being larger than said inner diameter of said neck (3), heating said sleeve (7), and pressing said sleeve (7) in its heated state into and through the neck (3) until said collar (8) snaps outwardly over an outer end of said neck (3).

2. The method according to claim 1 further comprising:

providing said neck (3) with inwardly directed impressions, and providing said sleeve (7) with projecting ribs for operative engagement with said impressions in said neck (3).

3. The method according to claims 1 or 2 further comprising:

connecting said flange (6) to said vessel wall by welding after said sleeve (7) is inserted into said neck (3).

4. The method according to claim 3 wherein said vessel wall has an inner surface of unprepared clean steel where said flange (6) is welded to said vessel wall.

5. The method according to claim 3 wherein said vessel wall has an inner surface of prepared steel where said flange (6) is welded to said vessel wall.

6. The method according to claim 3 further comprising:

adhering a synthetic foil to said vessel wall, and welding said flange (6) to said vessel wall upon said synthetic foil.

7. The method according to claim 3 further comprising:

coating said vessel wall with a powder of thermoplastic synthetic material before welding said flange (6) to said vessel wall.

8. The method according to claim 3 further comprising:

forming a loose liner in said vessel which has a synthetic layer forming a part thereof, and welding said flange (6) upon said synthetic layer.

* * * * *

UNITED STATES PATENT AND TRADEMARK OFFICE

CERTIFICATE OF CORRECTION

PATENT NO. : 4,757,594

DATED : July 19, 1988

INVENTOR(S) : Kars et al.

It is certified that error appears in the above-identified patent and that said Letters Patent is hereby corrected as shown below:

Col. 1, line 8, "innerside" should read --inner side--;

line 19, "above" should read --sleeve--;

line 29, "(According" should read --According--;

line 33, "sleeve,)" should read --sleeve,--.

Col. 2, line 42, "DRAWINGS" should read "PREFERRED EMBODIMENT";

line 57, "(In" should read --In--;

line 58, "3.)" should read --3.--.

Signed and Sealed this

Twenty-eighth Day of March, 1989

*Attest:*

DONALD J. QUIGG

*Attesting Officer*

*Commissioner of Patents and Trademarks*